US005390689A

United States Patent [19]

Graillat

[11] Patent Number: 5,390,689

[45] Date of Patent: Feb. 21, 1995

[54] COLLAPSIBLE DWELLING

[76] Inventor: Alain P. V. Graillat, 4, place de la Convention, F-38130 Echirolles, France

[21] Appl. No.: 915,859

[22] PCT Filed: Feb. 4, 1991

[86] PCT No.: PCT/FR91/00076

§ 371 Date: Aug. 3, 1992

§ 102(e) Date: Aug. 3, 1992

[87] PCT Pub. No.: WO91/11577

PCT Pub. Date: Aug. 8, 1991

[30] Foreign Application Priority Data

Feb. 5, 1990 [FR] France ..... 90 01309
Feb. 23, 1990 [FR] France ..... 90 02293

[51] Int. Cl.[6] ..... E04H 15/48

[52] U.S. Cl. ..... 135/126; 135/147; 52/63; 52/69; 52/71; 52/79.5; 52/646

[58] Field of Search ..... 135/98, 101, 106–111; 52/63, 71, 646, 69, 79.5

[56] References Cited

U.S. PATENT DOCUMENTS

| | | | |
|---|---|---|---|
| Re. 26,140 | 1/1967 | Schoenike | 135/109 |
| 1,913,572 | 6/1933 | Thoret-Drechsel | 135/109 |
| 2,168,913 | 8/1939 | Middleton | 135/106 |
| 2,473,076 | 6/1949 | Scheibner | 52/71 X |
| 2,546,730 | 3/1951 | Dickerson | 135/109 X |
| 2,936,771 | 5/1960 | Marchfield et al. | 135/111 X |
| 3,371,671 | 2/1968 | Kirkham . | |
| 3,424,178 | 1/1969 | Yoshimi-Yazaki | 135/106 X |
| 4,066,089 | 1/1978 | Rainwater | 135/DIG. 9 |
| 4,286,612 | 9/1981 | Neal et al. | 135/106 X |
| 4,825,891 | 5/1989 | Machado . | |

FOREIGN PATENT DOCUMENTS

| | | |
|---|---|---|
| 2118058 | 7/1972 | France . |
| 889455 | 2/1962 | United Kingdom . |
| 976912 | 12/1964 | United Kingdom . |
| 1600242 | 10/1981 | United Kingdom . |
| 8603243 | 6/1986 | WIPO . |

*Primary Examiner*—Michael Safavi
*Assistant Examiner*—Robert Canfield
*Attorney, Agent, or Firm*—Beveridge, DeGrandi, Weilacher & Young

[57] ABSTRACT

A collapsible accommodation structure (1) comprising a base (2), at least two opposite side walls (3, 4) connected to said base and inwardly foldable one over the other, and a roof (7) which is connected to said opposite side walls (3, 4) so that it can be folded with the walls while being turned over so that in the collapsed position, the roof (7) lies between said walls with its top side facing the outside of one of the side walls and its underside facing the inside of the other side wall.

38 Claims, 10 Drawing Sheets

COLLAPSIBLE DWELLING

The present invention relates to a collapsible dwelling, the sidewalls of which can occupy an opened-out position and a collapsed position, its purpose being especially to provide a dwelling whose structure is simple to manufacture and which is particularly simple to collapse and to open out.

A tent frame is known, from Patent FR-A-2, 118,058, which comprises four uprights whose top ends are connected via a X-shaped structure, it being possible to collapse this frame by lowering the central part of the X-shaped structure, thus causing the uprights to move close together in parallel towards the center, and conversely for opening it out.

Tents are also known which open out and collapse in the manner of concertinas. Such tents are described in Patents GB-A-976,912, U.S. Pat. No. 3,373,671, GB-A-889,455, GB-A-1,600,242 and U.S. Pat. No. 4,066,089.

A collapsible tent is known, from Patent U.S. Pat. No. 4,825,891, which comprises two U-shaped opposing frames, the ends of which can be pushed into the ground, this tent collapsing by bringing the two frames side by side.

A collapsible tent is also known, from Patent B GB-A-2,204,337, which comprises three U-shaped frames, which the ends of their corresponding branches are connected in an articulated manner, this tent collapsing by pivotally moving its frames close together.

A collapsible dwelling, in which the roof is separable from the sidewalls, is known, moreover, from tent WO-A-8,603,243.

The present invention provides a collapsible dwelling of a completely different design from those described especially in the aforementioned documents, especially as regards its method of folding or unfolding.

Another object of the present invention is to provide a collapsible dwelling whose ratio of volume in the open-out position to that in the collapsed position is particularly large.

The collapsible dwelling according to the invention comprises a base (2), at least two opposite sidewalls (3, 4) connected in an articulated manner to said base and which can be inwardly folded down one over the other, and a roof (7), which is connected to the top part of said opposite sidewalls (3, 4). The roof continuously connects the opposite sidewalls so that, during the collapsing of the dwelling, the roof is turned over, such that, in the collapsed position, the roof lies between said opposite sidewalls.

Thus, in the collapsed position, the topside of the roof can lie facing the outside of one of said sidewalls, its underside lying facing the inside of the other sidewall.

In a variant of the invention, the roof is rigid and is connected in an articulated manner to said sidewalls.

In another variant, the roof can be formed by a sheet connected to said opposite sidewalls.

In a preferred embodiment, said sidewalls comprise a peripheral frame, a sheet having two portions respectively fastened to said frames of said sidewalls and, between these two portions, a central portion forming said roof.

Said frees can advantageously be U-shaped, of which the ends of their opposite branches forming uprights are articulated to said base and of which their central branch forming a cross-piece lies underneath and carries said sheet.

The dwelling according to the invention can furthermore comprise at least one other sidewall whose top edge lies along a free edge of the roof, the latter being equipped with a flap covering the top part of the outside of this other sidewall, this other sidewall being connected to said base and being able to be inwardly folded down.

Preferably, said opposite sidewalls can be equipped with flaps covering the edges of the outside of said other sidewall.

Said flaps can be formed by extensions of said sheet.

Furthermore, said flaps and the outside of said other sidewall are preferably equipped with detachable fastening means.

In a preferred variant, said other wall comprises a top part and a bottom part which are articulated such that the top part can be folded down over the bottom part.

According to an advantageous embodiment, said bottom part comprises a U-shaped frame, the ends of the opposite branches of which, forming uprights, are articulated to said base and said top part comprises a U-shaped frame, the ends of the opposite branches of which, forming uprights, are articulated to the central branch of the frame forming a cross-piece of said bottom part, said other wall furthermore comprising a sheet connected to its frames.

Said top part is preferably smaller than said bottom part so that it can be folded down between the branches of this bottom part.

In a variant, the branches forming uprights of the frame of at least one of said sidewalls are elbowed so that this bottom part is outwardly bowed at its bottom part.

In another embodiment of the invention, the roof encloses a deformable structure enabling the top parts of said opposite sidewalls to be moved close together and apart.

According to the present invention, said deformable structure comprises, preferably, two parts respectively articulated to the top part of said opposite sidewalls and assembled telescopically.

In a preferred variant embodiment, said deformable structure comprises at least two tubes mounted telescopically one over the other, the opposite ends of these telescopic tubes being respectively connected in an articulated manner to the top parts of said opposite sidewalls, the roof comprising a sheet carried by this deformable structure.

According to the invention, said opposite side-walls preferably comprise a frame, a sheet having two portions respectively fastened to these frames and, between these two portions, a central portion forming said roof and carried by the deformable structure of the latter.

Said frames are preferably U-shaped, of which the ends of their opposite branches forming uprights are articulated to said base and of which their central branch forming a cross-piece lies underneath and carries said sheet.

According to the invention, said sheet can advantageously have at least one portion which extends laterally of said roof so as to constitute another sidewall and which is connected to the corresponding edges of said opposite sidewalls which can be folded down.

In a variant, said roof has an outward extension which extends beyond one of said sidewalls which can be folded down, this extension being connected to this sidewall and being able to be folded down against the outside of the latter.

Said extension of the roof is preferably connected to said deformable structure of the latter so as to be able to be collapsed at the same time.

Said extension of the roof can advantageously comprise a u-shaped frame, the ends of the opposite branches of which are connected in an articulated manner to the top part of the associated sidewall, said sheet having a portion which is carried by this frame. This sheet portion can, optionally, envelop said extension of the roof and lie between the sheet portion constituting the roof and the sheet portion constituting the associated sidewall.

According to the invention, means are provided for retaining said deformable structure when the dwelling is in the opened-out position.

According to the invention, said base can advantageously comprise a peripheral frame to which the frames of said sidewalls are articulated.

in a preferred embodiment, said frames are tubular and the ends of the branches of said frames are preferably equipped with articulation rings traversed by the frame which carries them.

The dwelling of the invention can furthermore comprise a bottom sheet connected to the sheets forming its sidewalls or extending them beneath said base.

Advantageously, at least one of said sheets can comprise sheaths into which extend respectively at least some of the branches of the frame which carries it.

The present invention will be better understood by studying collapsible dwellings described by way of non-limiting examples and illustrated by the drawing in which.

Figure 10:
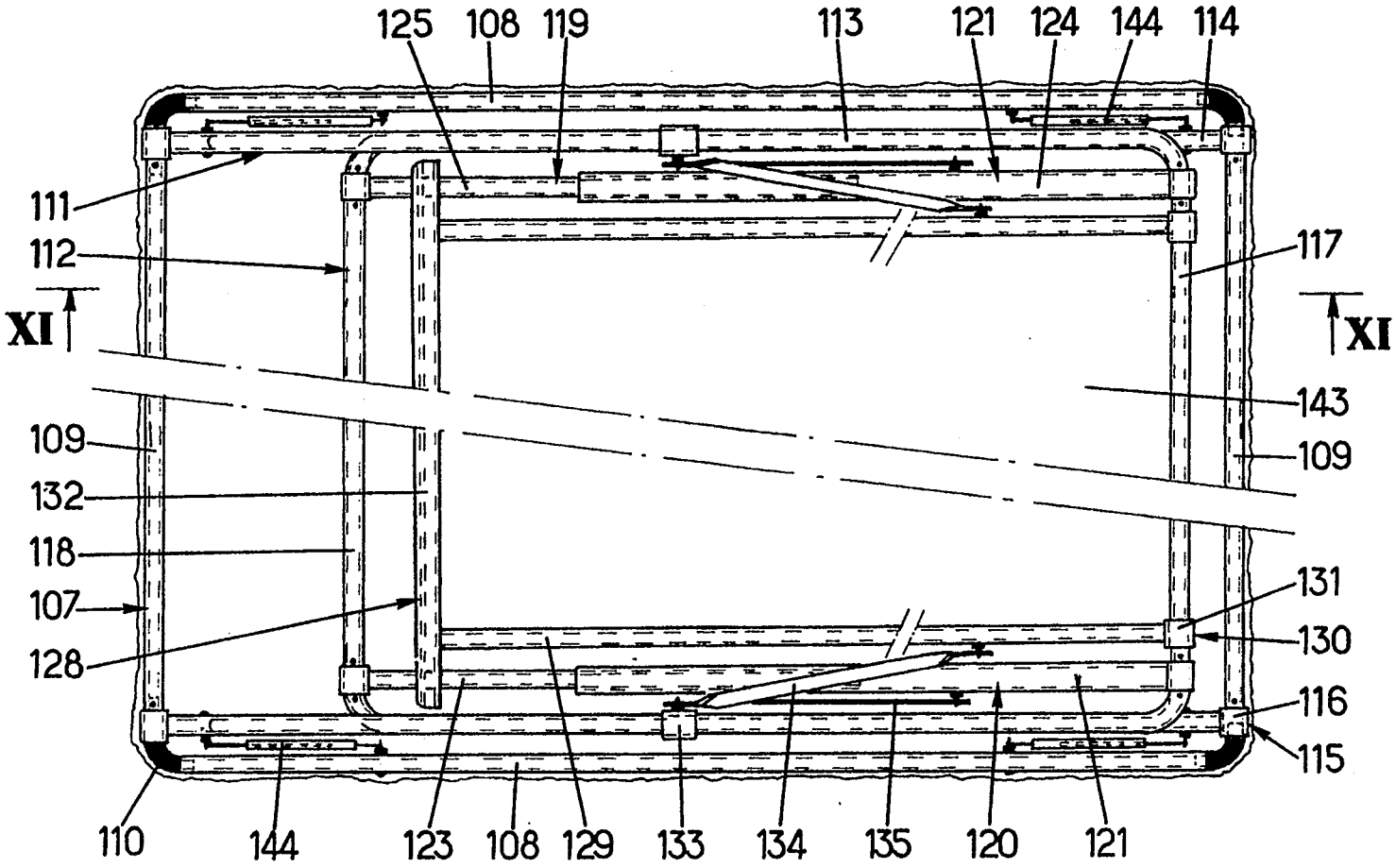
FIG. 10 represents a plan view of the aforementioned dwelling, in the collapsed position.
Figure 11:
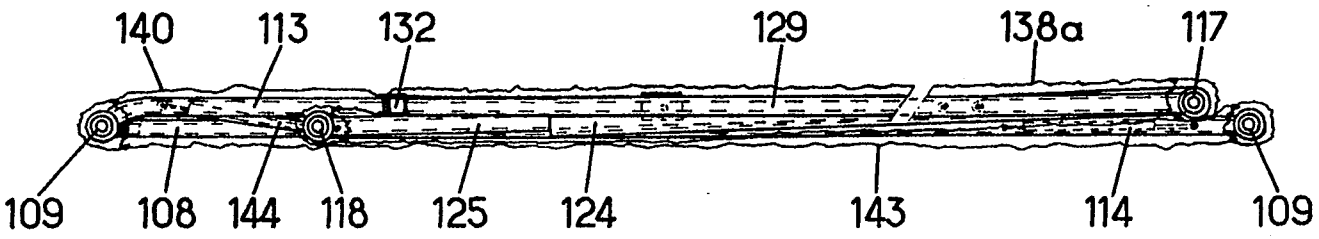

and FIG. 11 represents a longitudinal cross section of the aforementioned dwelling, in the collapsed position and along XI—XI of FIG. 10.

Figure 1:
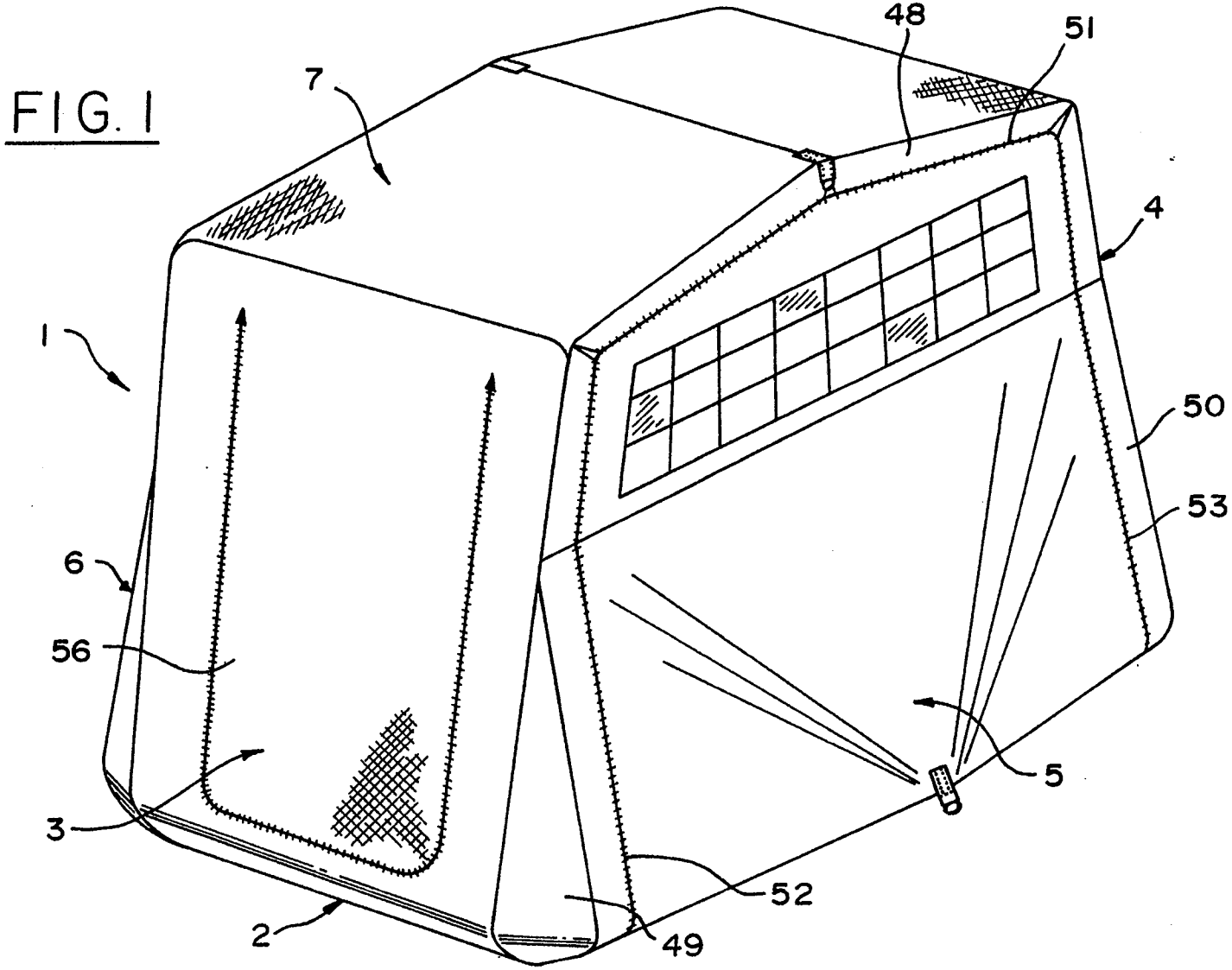
FIG. 1 represents a perspective exterior view of a collapsible dwelling according to the present invention, in the opened-out position.

Referring to FIG. 1, it may be seen that the collapsible dwelling represented in the opened-out position in this Figure and identified generally by the designation 1 comprises a rectangular horizontal base 2 intended in particular to rest on the ground, two opposite sidewalls 3 and 4 associated with the two opposite smaller opposite sides of the base 2 and two other opposite sidewalls 5 and 6 associated with the two larger opposite sides of the base 2, and a roof 7 opposite the base 2.

Referring to FIGS. 2 to 6, it may be seen that the dwelling 1 comprises a collapsible tubular rigid structure which is constructed in the following manner.

The base 2 comprises a tubular peripheral frame 8 which comprises two opposite longitudinal tubular bars 9 and two opposite transverse tubular bars 10. As may be better seen in FIG. 6, the ends of the transverse bars 10 carry fitted end-fittings 11 which have rings 12 into which the ends of the longitudinal bars 9 are fitted, the latter-being fastened to the rings 12, for example by rivets 13.

The opposite sidewalls 3 and 4 comprise U-shaped tubular peripheral frames 14 and 15. The ends of the opposite branches, respectively 16 and 17, of these frames 14 and 15, which constitute uprights, are mounted in an articulated manner respectively to the opposite transverse bars 10 of the base 2, in the vicinity of their ends. For this purpose, the ends of the branches 16 and 17 carry fitted end-fittings 18 which have rings 19 traversed by the transverse bars 10 of the base 2.

Thus, the frames 14 and 15 can be pivoted about the transverse bars 10 of the base 2 as far as a raised position in which their central branches 20 and 21 constitute horizontal top cross-pieces located some distance away from the base 2 and as far as an inwardly collapsed position in which they lie horizontally one over the other on the base 2, the length of their opposite branches 16 and 17 being slightly less than the length of the longitudinal bars 9 of this base 2.

Furthermore, the opposite branches 16 and 17 of the frames 14 and 15 are, in their bottom part, slightly elbowed outwardly so that they can lie, in the collapsed position, slightly above the plane of the base 2.

The sidewalls 5 and 6 of the dwelling 1 comprise respectively bottom tubular frames 22 and 23, articulated to the base 2, and top tubular frames 24 and 25, articulated to the bottom frames 22 and 23.

The bottom tubular frames 22 and 23 are U-shaped. The ends of their opposite branches, respectively 26 and 27, which constitute uprights, carry fitted end-fittings 28 which have rings 29 which are traversed by the longitudinal bars 9 of the base 2, in the vicinity of their ends, their central branches 30 and **30*a*, which are parallel to the longitudinal bars 9 of the base 2, constituting an intermediate cross-piece for the walls 5 and 6**.

The top frames 24 and 25 are also U-shaped. The ends of their opposite branches, respectively 31 and 32, which constitute uprights, carry fitted end-fittings 33 having rings 34 FIG. 2 which are traversed by the central branches 30 of the bottom frames 22 and 23, in the vicinity of their ends, their central branches 35 and **35*a* constituting top cross-pieces for the walls 5 and 6, which cross-pieces are generally parallel to the longitudinal bars 9 of the base 2**.

Since the opposite branches 31 and 32 of the top frames 24 and 25 are shorter than the branches 26 and 27 of the bottom frames 22 and 23 and the central branches 35 and **35*a* of the top frames 24 and 25 are shorter than the central branches 30 and 30*a* of the bottom frames 22 and 23, the frames 24 and 25 can be folded down between the branches 26 and 27 of the bottom frames 22 and 23**.

Figure 3:
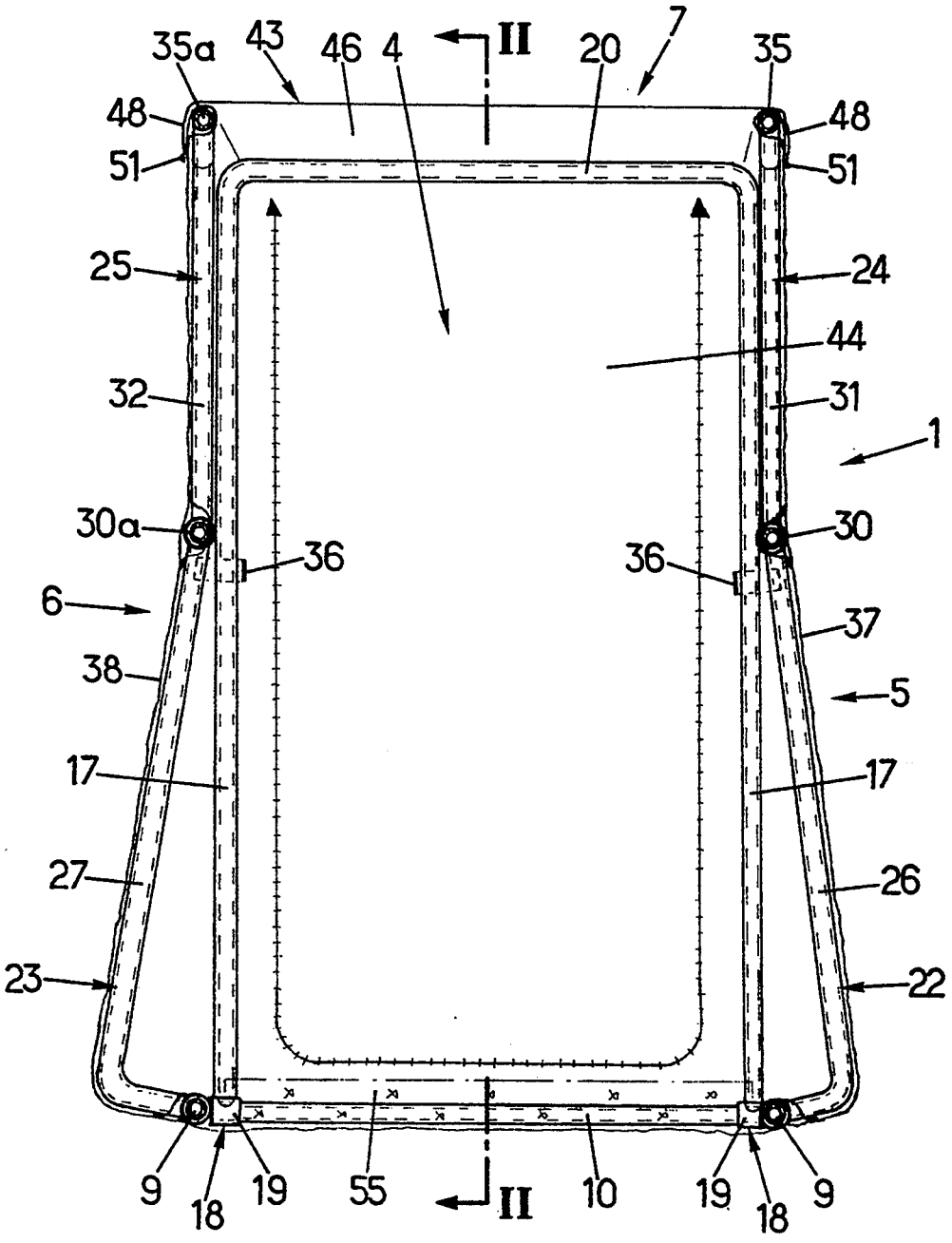
FIG. 3 represents a median cross section of the dwelling represented in FIG. 1, in the opened-out position, along III—III of FIG. 2.
Figure 4:
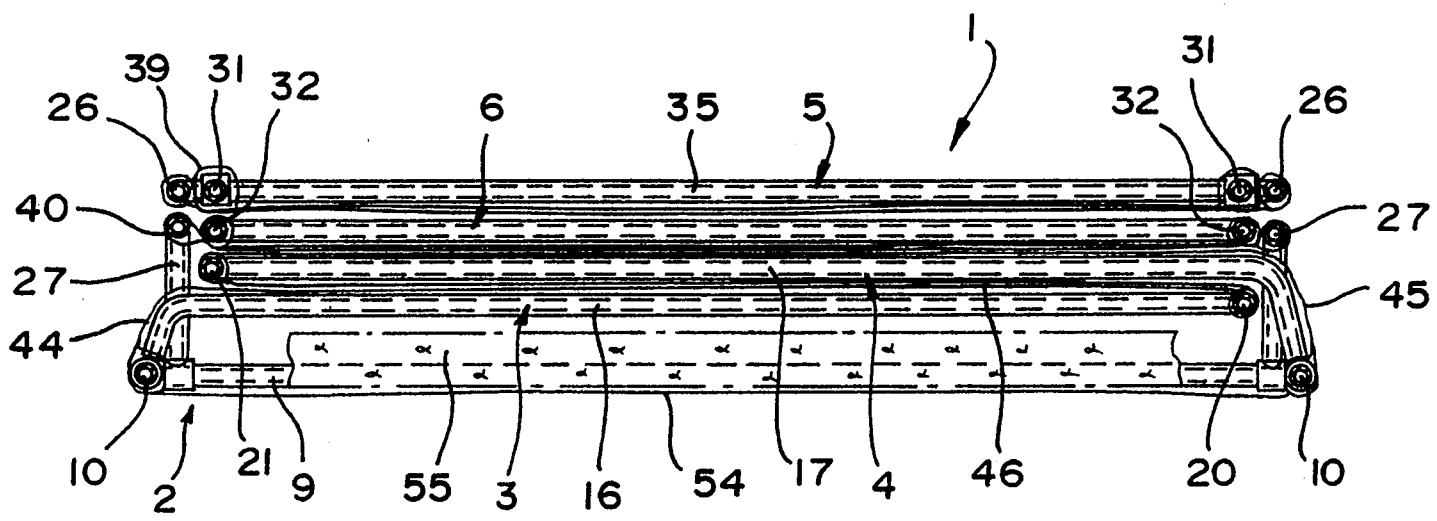
FIG. 4 represents a median longitudinal cross section of the aforementioned dwelling, in the collapsed position, in a view which corresponds to FIG. 2.
Figure 5:
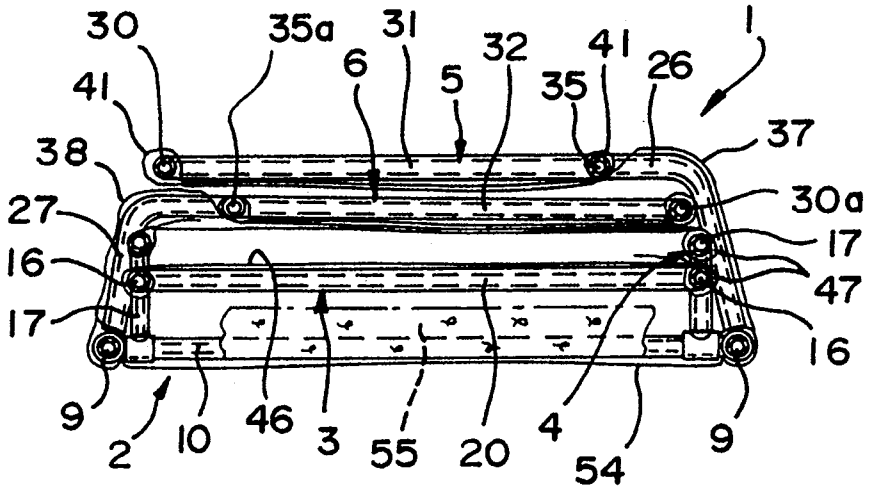
FIG. 5 represents a median cross section of the aforementioned dwelling, in the collapsed position, in a view which corresponds to FIG. 3.
Figure 6:
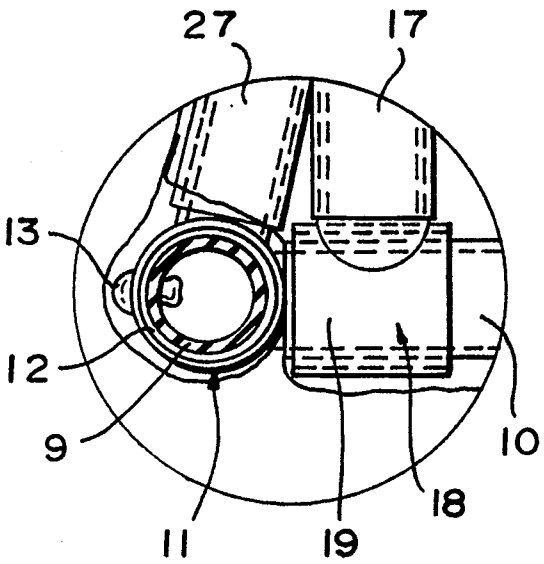
FIG. 6 represents an enlarged view of a bottom corner of the structure of the aforementioned dwelling.

It may furthermore be seen from FIG. 3 that the opposite branches 26 and 27 of the bottom frames 22 and 23 are, in their bottom parts, outwardly elbowed so as to have the shape of an L. Thus, when the frames 14 and 15 of the walls 3 and 4 are folded down, as has been seen hereinabove, it is possible inwardly to fold down, over these folded-down frames 14 and 15, the bottom frame 27 of the sidewall 6 and, over the latter, the bottom frame 26 of the wall 5. The L-shaped configuration of the opposite branches of the bottom frames 26 and 27 of the walls 5 and 6 is designed in order to permit this stacking so that their cross-pieces 30 are located towards the interior in relation to the longitudinal bars 9 of the base 2.

Figure 2:
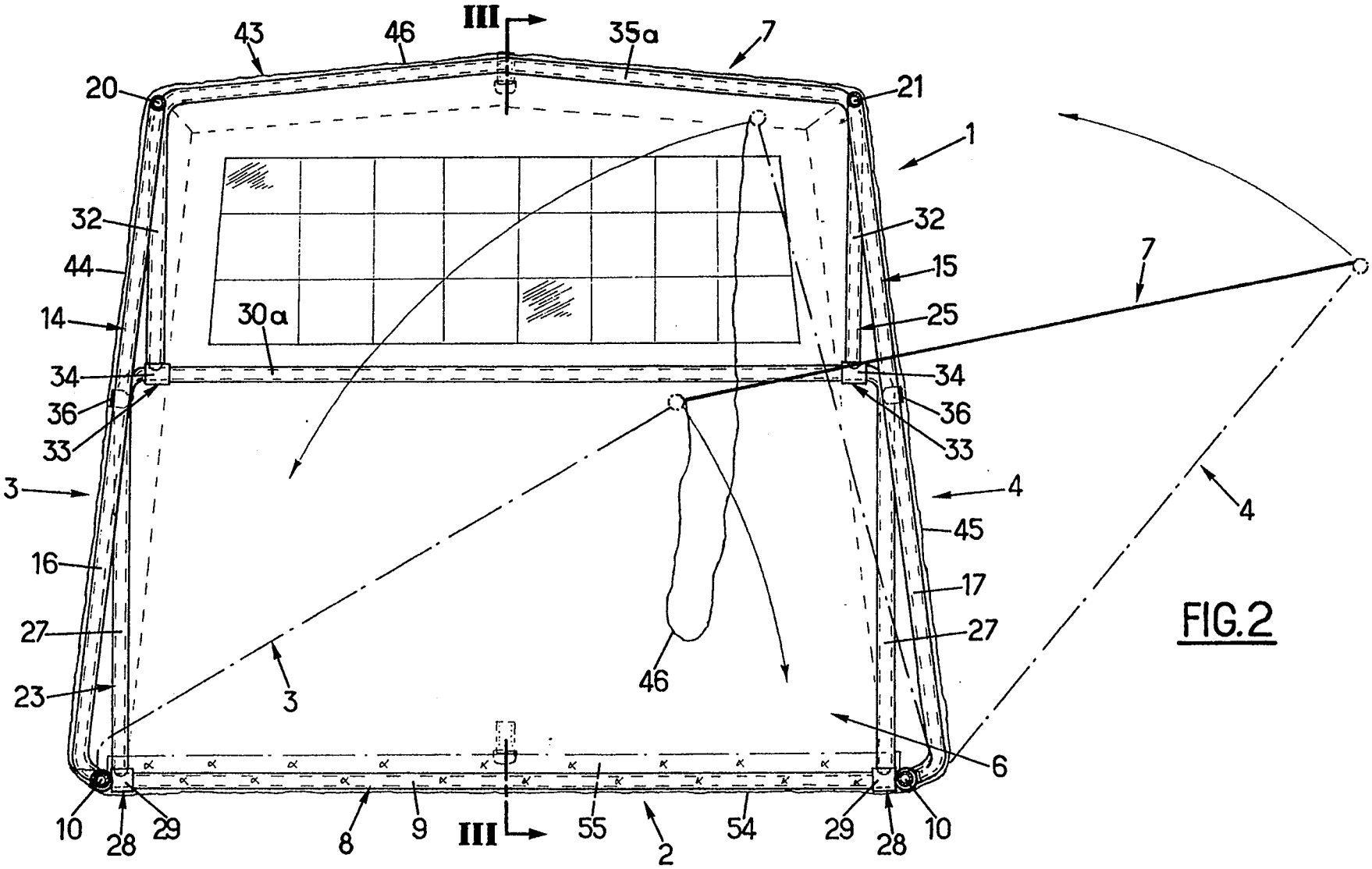
FIG. 2 shows a longitudinal median cross section of the dwelling represented in FIG. 1, in the opened-out position, along II—II of FIG. 3.

Referring to FIGS. 2 and 3, it may be seen that, when the walls 3, 4, 5 and 6 are in the opened-out position, the top corners of the bottom frames 22 and 23 of the walls 5 and 6 pass in the vicinity of and outside the opposite branches 16 and 17 of the frames 14 and 15 of the sidewalls 3 and 4 and that the top corners of the top frames 24 and 25 of the sidewalls 5 and 6 also lie in the vicinity of and outside the top corners of the frames 14 and 15 of the sidewalls 3 and 4. Thus, the top frames 24 and 25 lie vertically and the frames 14 and 15 are slightly inwardly sloped. In order to retain the bottom frames 22 and 23 of the sidewalls 5 and 6 in their aforementioned positions in relation to the frames 14 and 15 of the sidewalls 3 and 4, the opposite branches 16 and 17 of the frames 14 and 15 are equipped with hooks 36 into which the frames 22 and 23 engage laterally by inward rotation.

The collapsible rigid structure described hereinabove serves to carry enveloping sheets which are intended to form the sidewalls 3, 4, 5 and 6 of the dwelling 1 and its roof 7.

First of all, the opposite walls 5 and 6 of the dwelling 1 comprise sheets 37 and 38 which are dimensioned to cover their bottom 22 and 23 and top 24 and 25 frames. In order to fasten them thereto, the edges of these sheets 37 and 38 are made up, for example, in the shape of sheaths 39 and 40 in which, respectively, the opposite branches 26 and 27 of the bottom frames 22 and 23 and the opposite branches 31 and 32 of the top frames 24 and 25 lie. The sheets 37 and 38 furthermore have sheaths 41 in which the central branches 35 of the top frames 24 and 25 lie and, optionally, sheaths 41 in which the central branches 30 of the bottom frames 22 and 23 are received.

The opposite walls 3 and 4 and the roof 7 are made up with the aid of a continuous sheet 43 which has two portions 44 and 45 covering the frames 14 and 15, which portions are separated by a central portion 46 whose length corresponds substantially to the length of the central branches 35 of the top frames 24 and 25 of the opposite walls 5 and 6, this central portion 46 forming the roof of the dwelling 1. In order to fasten this sheet 43 to the frames 14 and 15 of the walls 3 and 4, the opposite edges of this sheet have, in one example, sheaths 47 in which the branches 16 and 17 of the frames 14 and 15 of the walls 3 and 4 lie. As may be seen in FIG. 2, the sheet 43 goes round over the top and bears on the central branches forming cross-pieces 20 and 21 of the frames 14 and 15.

The free edges of the central portion 46 of the sheet 43 are extended laterally by flaps 48 which pass over the central branches 35 and 35*a* forming top cross-pieces of the lateral walls 5 and 6 and cover the top part of the outside of the sheets 37 and 38 forming these sidewalls 5 and 6.

Furthermore, the portions 44 and 45 of the sheet 43, covering the frames 14 and 15 of the sidewalls 3 and 4, are extended by flaps 49 and 50 which go around the opposite branches 26, 27 and 31, 32 forming uprights of the lateral walls 5 and 6 and cover the vertical opposite outside edges of these sidewalls 5 and 6.

Furthermore, the flaps 48, 49 and 50 and the outsides of the sheets 37 and 38 of the walls 5 and 6 are connected via detachable means, for example via zippers 51, 52 and 53. These flaps can thus be stretched. As a result, in particular, the edges of the central portion 46 of the sheet 43, which forms the roof 7, are carried by the top cross-pieces 35 and 35*a* of the top frames 24 and 25 of the walls 5 and 6, this central portion 46 being stretched between these cross-pieces. Since these cross-pieces are slightly elbowed upward in their central part, the roof 7 has two slopes slightly inclined towards the sidewalls 3 and 4.

The dwelling 1 also comprises a sheet 54 forming a bottom, which lies under the frame 8 of the base 2 and which is connected to the bottom parts or which extend the sheets 37, 38 and 43 constituting the sidewalls 3, 4, 5 and 6.

In order to collapse the dwelling 1 from its opened-out position described hereinabove, it is possible to proceed in the following manner.

First of all, the two parts of the zippers 51 to 53 connecting the flaps 48 to 50 to the outsides of the sidewalls 5 and 6 are detached.

These flaps of the side and top edges of these sidewalls 5 and 6 are released.

The sidewalls 3 and 4 are moved apart outwardly so as to release the hooks 36.

The sidewalls 5 and 6 are moved slightly further apart, outwardly.

The opposite sidewalls 3 and 4 are inwardly folded down, one after the other. This being done, as is seen in FIG. 2, the central portion 46 forming the roof 7 is turned over so that, in the collapsed position, this central portion lies between the walls 3 and 4, its outside facing the outside of the first folded-doom sidewall and its inside facing the inside of the second folded-down sidewall.

The top parts of the sidewalls 5 and 6 are folded doom over the outside of their bottom part and these top parts are folded doom, one over the other, over the already folded-down walls 3 and 4.

In order to return the dwelling 1 into its opened-out position, the procedure is carried out in a reverse manner.

The dwelling which has just been described can be manufactured in various ways.

However, it is possible, simply, to make up its collapsible rigid structure, to cut out a sheet made from a single piece so as to give it, when flat, the shape of a cross whose adjacent portions correspond to the sheets 37, 38, 43 and 54 and to fix attaching strips to this sheet at the locations corresponding to the aforementioned sheaths and the zippers.

Next, the collapsible rigid structure is laid on this sheet, its frames being outside and in the extension of the sidewalls 3, 4, 5 and 6 of the frame forming the base 2 and the sheaths are formed around the branches of the frames.

Then, the opposite walls 3 and 4 are raised back up and the opposite edges of the sheet are assembled so as to form the roof 7.

The manufacture of the dwelling 1 is completed. The sidewalls 5 and 6 are raised back up and the dwelling 1 can be placed in its opened-out position or in its collapsed position over its base. If desired, it is possible to place, permanently, a mattress 55 in the dwelling 1 without being a nuisance on folding-up, taking into the account the fact that aforementioned frames are outwardly elbowed in their bottom part.

Of course, the wall 3 may, in particular, comprise an opening 56 formed by a cut-out in the sheet 44.

In the dwelling described hereinabove, the sidewalls could be rigid as well as the roof, articulations consequently having to be provided for the folding-up and flaps being able to provide the leaktightness. Other variants would be possible of course.

Figure 7:
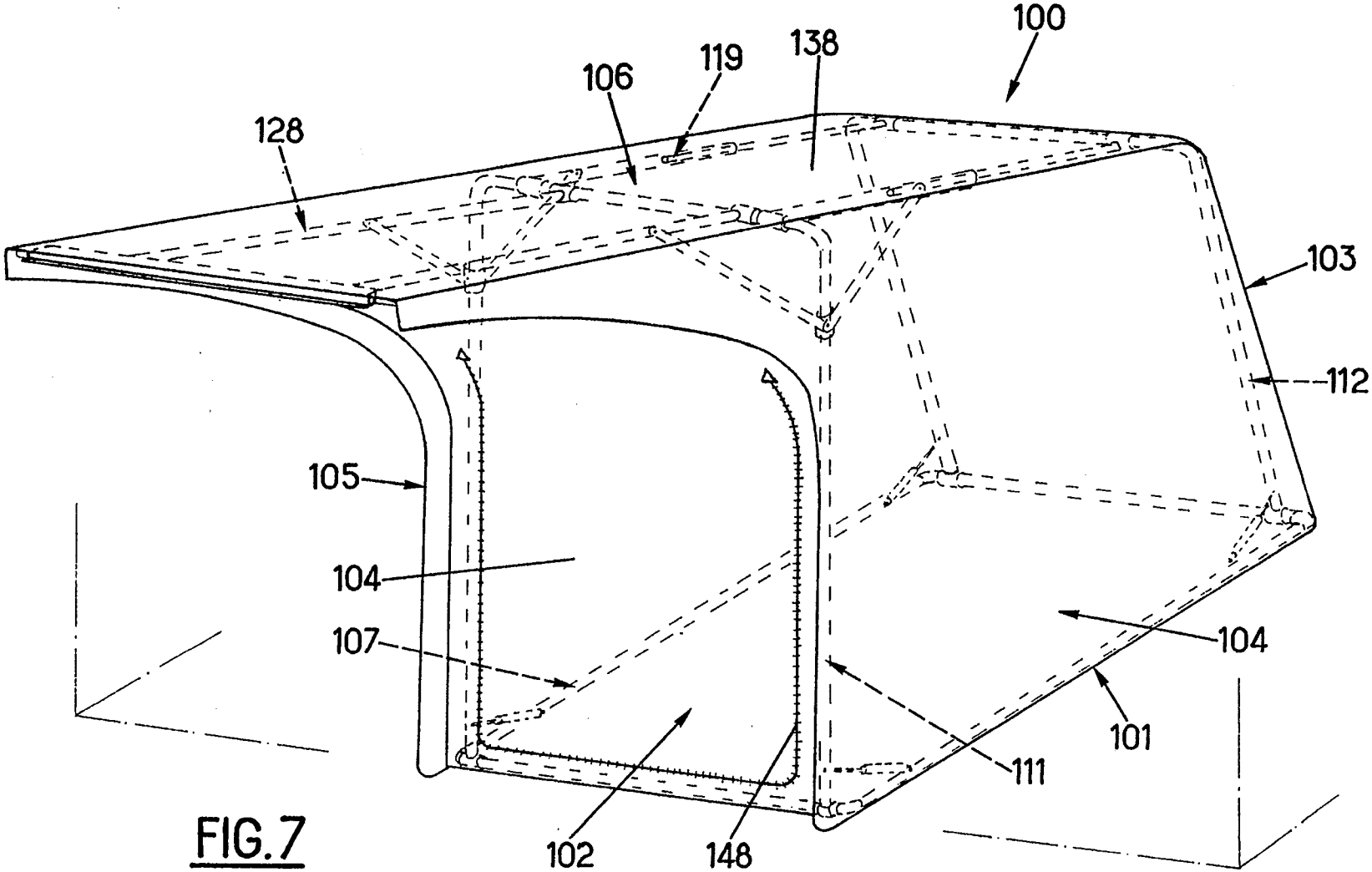
FIG. 7 represents a perspective exterior view of another collapsible dwelling according to the present invention, in the opened-out position.

Referring now to FIG. 7, it may be seen that the collapsible dwelling, represented in the opened-out position in this Figure and identified generally by the designation 100, comprises a rectangular horizontal base 101 intended, in particular, to rest on the ground, two opposite sidewalls 102 and 103 associated with the two smaller opposite sides of the base 101 and two other opposite sidewalls 104 and 105 associated with the two larger sides of the base 2, as well as a roof 106 opposite the base 101 and which has an outward extension **106*a* which extends beyond the sidewall 102**.

Figure 8:
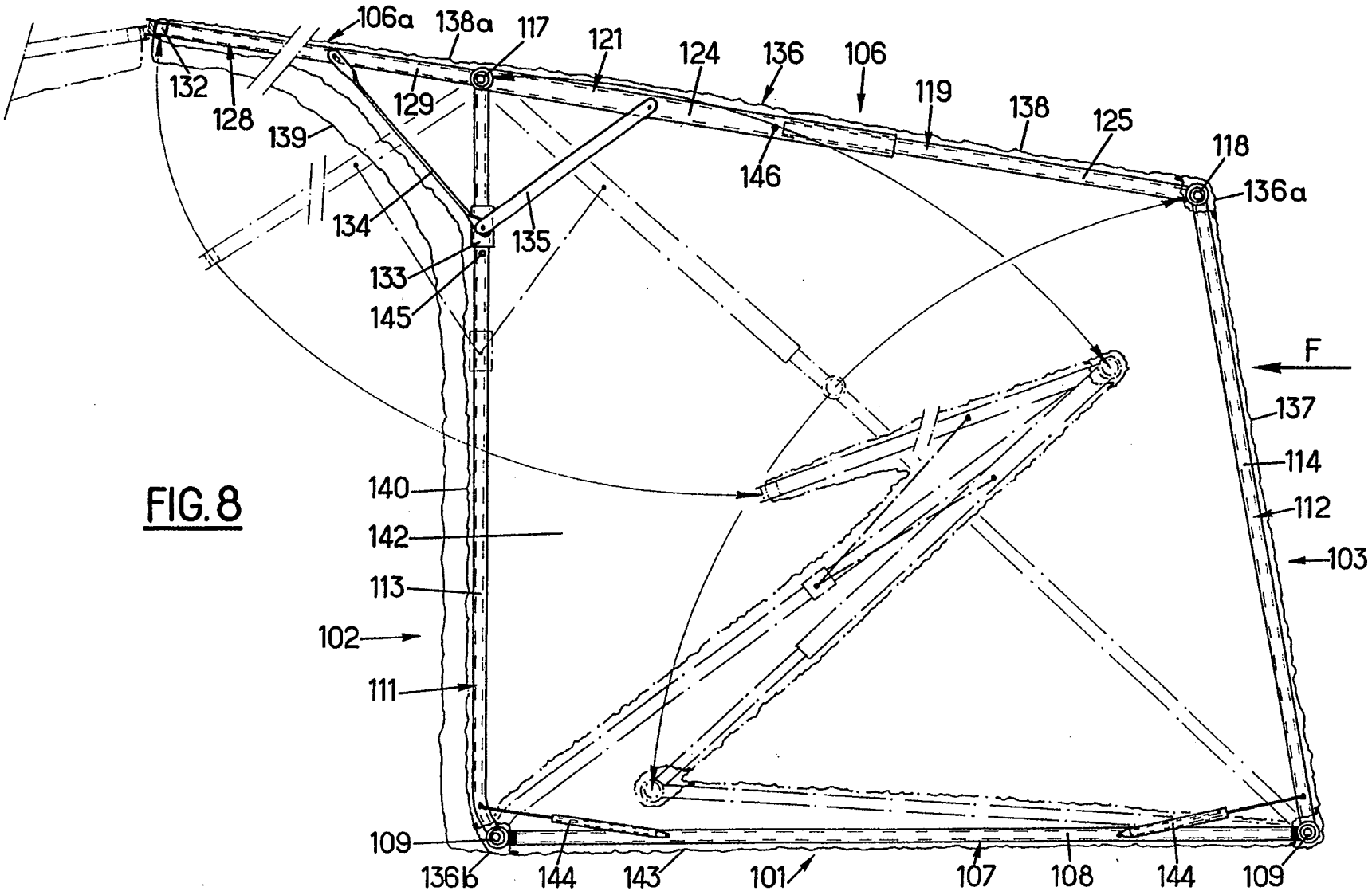
FIG. 8 shows a longitudinal median cross section of the dwelling represented in FIG. 7, in the, opened-out position, along VIII—VIII of FIG. 9.
Figure 9:
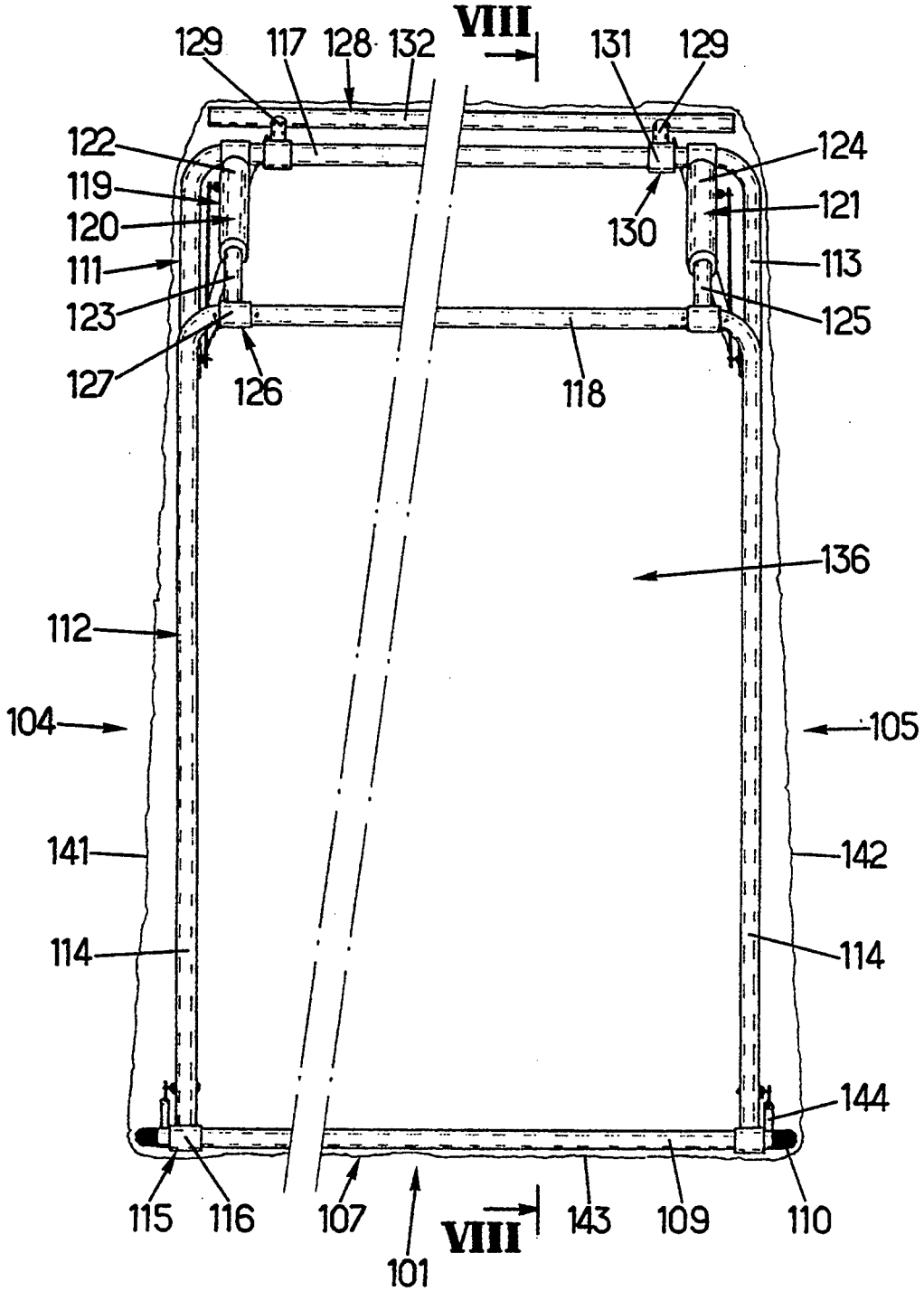
FIG. 9 represents a side view of the aforementioned collapsible dwelling, in the opened-out position and along the arrow F of FIG. 8.

Referring now to FIGS. 7 to 9, it may be seen that the collapsible dwelling 100 comprises a collapsible tubular rigid structure which is constructed in the following manner and which will be described in the opened-out position.

The base 101 comprises a tubular peripheral frame 107 which comprises two opposite longitudinal tubular bars 108 and two opposite transverse tubular bars 109. As may be more easily seen in FIG. 10, the tubes 108 and 109 are fastened together by virtue of elbows 110 which are fitted into their ends.

The opposite sidewalls 102 and 103 comprise U-shaped tubular peripheral frames 111 and 112. The ends of the opposite branches, respectively 113 and 114, of these frames 111 and 112, which constitute uprights, are mounted in an articulated manner respectively to the opposite transverse bars 109 of the base 101, in the vicinity of their ends. For this purpose, the ends of the branches 113 and 114 carry fitted end-fittings 115 which have rings 116 traversed by the transverse bars 109 of the base 2. The frames 111 and 112 furthermore have central branches 117 and 118 which are parallel to the transverse bars 109 of the base 101 and which constitute horizontal top cross-pieces.

The roof 106 has a deformable structure 119 which is connected in an articulated manner to the top cross-pieces 117 and 118 of the sidewalls 102 and 103. This deformable structure 119 comprises two telescopic longitudinal bars 120 and 121 which determine the two longitudinal edges of the roof 106. These bars 120 and 121 comprise two tubes respectively 122, 123 and 124, 125 which are respectively fitted one into the other in a sliding manner, and the opposite ends of which are equipped with fitted end-fittings 126 which have rings 127 traversed by the central bars 117 and 118 of the sidewalls 111 and 112, in the vicinity of their ends.

The extension **106*a* of the roof 106 comprises a U-shaped tubular peripheral frame 128 which has two longitudinal branches 129, the ends of which carry fitted end-fittings 130 which have rings 131 which are traversed by the top cross-piece 117 of the sidewall 102, in the vicinity of its ends and inside the end rings 127 of the longitudinal bars 120 and 121. The frame 128 furthermore has a central bar 132 which constitutes a cross-piece parallel to the cross-piece 117 and which extends beyond each side of its longitudinal branches 129**.

Sliding sleeves 133, which are connected, on the one hand, to the longitudinal branches 129 of the frame 128 and, on the other hand, to the longitudinal bars 120 and 121 of the deformable structure 119 via, respectively, linkage bars 134 and 135 so as to constitute a deformable triangulated system, are mounted on the uprights 113 of the frame 111 of the sidewall 102.

The collapsible rigid structure described hereinabove serves to carry an enveloping sheet 136, made from one or more assembled pieces, which is intended to form the walls and the roof of the dwelling 100. This sheet 36 comprises a portion 137 which covers the frame 112 of the sidewall 103, a portion 138 which covers the deformable structure 119 and is extended by a portion **138*a* which covers the frame 128, a portion 139 which covers this frame 138 underneath and which is extended by a portion 140 which covers the frame 111 of the wall 102, a portion 141 which constitutes the sidewall 104 and a portion 142 which constitutes the wall 105. Furthermore, the sheet 136 comprises a portion 143 which extends beneath the frame 107 of the base 101 and which forms a bottom for the dwelling. Thus, the sheet 136 goes around and bears on the various branches or bars of the previously described collapsible rigid structure of the dwelling 100** so that this structure is completely enveloped.

Furthermore, for the retention of the sheet 136 over the collapsible rigid structure described herein-above, this sheet can have sheaths through which extend at least some of the bars or branches of this structure. Thus it is possible to provide a sheath **136*a* traversed by the top central branch 118 of the frame 112 of the sidewall 103 and sheaths 136*b* traversed by the transverse bars 109 of the frame 107 of the base 101**.

In the example represented, the dwelling 100, in the opened-out position, has a vertical wall 102, an opposite wall 103 which is slightly inclined inward, a roof 106 which is slightly inclined in the direction of the sidewall 103 and sidewalls 104 and 105 which are very slightly inclined inward.

In order to retain the dwelling 100 in this opened-out position, four Jacks 144 are provided which are mounted between the longitudinal bars 108 of the frame 107 of the base 101 and the branches 113 and 114 forming uprights of the frames 111 and 112 of the side-walls 102 and 103 and which tension the sheet 136 somewhat. It is furthermore possible to provide dismantleable stop pins 145 in order to lock the sliding sleeves 133 the uprights 113 of the frame 111 of the wall 102 and stop pins 146 locking the telescopic tubes of the deformable structure 119 of the roof 106.

Of course, the sheet 136 may, in particular, comprise an access opening 146 formed by a cut-out in its portion 140 forming its sidewall 102, the edges of this cut-out being able to be assembled detachably, for example by a zipper 148. Other openings could be made in its other walls. In addition, the enveloping sheet 136 could have rapid attachment means enabling several dwellings 100 to be combined one beside another or several dwellings 100 one facing another in positions such that their aforementioned extensions of the roof 106 face each other, these extensions then constituting a passage corridor between the facing sidewalls 102 of the dwellings 100 thus combined.

There will now be described how it is possible to proceed in order to collapse the dwelling 100 from its opened-out position represented in FIGS. 7, 8 and 9 so as to bring it into its collapsed position represented in FIGS. 10 and 11.

First of all, from inside the dwelling 100, the possible stop pins 145 and 146 are removed. On coming out, the opening 146 is closed up again. Then, from outside, the sidewall 103 is inwardly folded down by compressing the associated jacks 144. This being done, the telescopic longitudinal bars 120 and 121 of the roof 106 reduce their lengths, the top central branch 118 of the frame 112 of the sidewall 103 moves close to the top central bar 117 of the frame 111 of the sidewall 102. At the same time, under the effect of the triangulated systems constituted by the bars 134 and 135, the sleeves 133 slide downward along the opposite branches 113 of the frame 111 of the wall 102, thus causing the frame 128 to pivot downward about the top central branch 117 of this frame 111.

As soon as the top central branch 118 of the frame 112 constituting the wall 103 is beyond the plane passing the top central branch 117 of the free 111 of the wall 102, it is possible to start folding down this sidewall 102.

As shown in FIGS. 10 and 11, when the dwelling 100 is brought completely to its collapsed position, the sidewall 103 lies over the base 101, the roof portion 106 associated with the telescopic longitudinal bars 120 and 121 lies over the sidewall 103, the sidewall 102 lies over this roof portion and the roof portion 106*a* associated with the frame 128 is folded down ever this sidewall 102. Thus, that portion of the roof 106 associated with the telescopic tubes 120 and 121 and lying between the top central branches 117 and 118 of the sidewalls 102 and 103 is turned right over.

The portions 141 and 142 of the sheet 136 which constitute the sidewalls 104 and 105 can then be suitably collapsed and these collapsed portions brought back over the collapsed assembly.

Taking into account the arrangement of the various elements constituting the collapsible rigid structure of the dwelling 100, the various frames being capable of interpenetrating, it may be seen from FIG. 10 and, more precisely from FIG. 11, that the dwelling 100 in the folded position occupies a very small thickness in relation to the height which it occupies in the opened-out position. Furthermore, the outsides of the sheet 136 are not in contact, at any location, with the insides.

In order to rearrange the dwelling 100 into the opened-out position, it suffices to proceed in the reverse manner, helped for this by the jacks 144.

Of course, in the dwelling described hereinabove with reference to FIGS. 7 to 11, the deformable structure of the roof could especially be a different embodiment.

I claim:

1. A dwelling which is collapsible from an opened-out position to a collapsed position, said dwelling comprising:

a base structure having opposite edges, at least first and second opposite sidewalls each having an inner face, an outer face, a bottom part and a top part, said bottom parts of said sidewalls being articulated on opposite edges of the base so as to be inwardly foldable down over said base, one over the other, a roof extending between the top parts of said opposite sidewalls and being movable relative to these top parts, said roof having an upper face and a lower face in said opened-out position of the dwelling, said roof being movable to a collapsed position in response to folding of the opposite sidewalls one before the other, said roof being turned over during its movement to said collapsed position so that, in its collapsed position, said upper face of the roof faces down toward the outer face of the first sidewall and the lower face of the roof faces up toward the inner face of the second sidewall, said roof in its collapsed position lying between said opposite sidewalls.

2. Dwelling according to claim 1, characterized in that the roof includes a rigid frame structure connected in an articulated manner to said sidewalls.

3. Dwelling according to claim 1, characterized in that the roof includes a sheet connected to said opposite sidewalls.

4. Dwelling according to claim 1, characterized in that each of said sidewalls includes a frame, a sheet having two portions respectively fastened to said frames of said sidewalls and, between these two portions, a central portion forming said roof.

5. Dwelling according to claim 4, characterized in that said frames are U-shaped, of which the ends of their opposite branches forming uprights are articulated to said base and of which their central branch forming a cross-piece lies underneath and carries said sheet.

6. Dwelling according to claim 1, characterized in that it comprises at least one other sidewall having a top edge which lies along a free edge of the roof, said at least one other sidewall having an outside with a top part, said roof being equipped with a flap covering the top part of the outside of this other sidewall, this other sidewall being connected to said base and being able to be inwardly folded down.

7. Dwelling according to claim 6, characterized in that at least one other sidewall has an outside with edges, and said opposite sidewalls are equipped with flaps covering the edges of the outside of said at least one other sidewall.

8. Dwelling according to claim 6, characterized in that sheet portions cover said opposite sidewalls, and said flaps are formed by extensions of said sheet portions.

9. Dwelling according to claim 6, characterized in that said flap and the outside of said at least one other sidewall which has its top part covered by said flap are equipped with detachable fastening means.

10. Dwelling according to claim 6, characterized in that said at least one other sidewall comprises a top part and a bottom part which are articulated such that the top part can be folded down over the bottom part.

11. Dwelling according to claim 10, characterized in that said at least one other sidewall bottom part comprises a U-shaped frame, the ends of the opposite branches of which, forming uprights, are articulated to said base and said at least one other sidewall top part comprises a U-shaped frame, the ends of the opposite branches of which, forming uprights, are articulated to the central branch of the frame forming a cross-piece of said at least one other sidewall bottom part, said at least one other sidewall furthermore comprising a sheet connected to its frames.

12. Dwelling according to claim 11, characterized in that said at least one other sidewall top part is smaller than said at least one other sidewall bottom part so that it can be folded down between the branches of said at least one other sidewall bottom part.

13. Dwelling according to claim 11, characterized in that the branches forming uprights of the frame of at least one of said sidewalls are elbowed.

14. Dwelling according to claim 1, characterized in that the roof includes a deformable frame structure enabling the top parts of said opposite sidewalls to be moved close together and apart.

15. Dwelling according to claim 14, characterized in that said deformable frame structure comprises two parts respectively articulated to the top part of said opposite sidewalls and assembled telescopically.

16. Dwelling according to claim 14, characterized in that said deformable frame structure comprises at least two tubes mounted telescopically one over the other, the opposite ends of these telescopic tubes being respectively connected in an articulated manner to the top parts of said opposite sidewalls, the reef including a sheet carried by this deformable frame structure.

17. Dwelling according to claim 14, characterized in that said opposite sidewalls comprise a frame, a sheet having two portions respectively fastened to these frames and, between these two portions, a central portion forming said roof and carried by the deformable frame structure.

18. Dwelling according to claim 17, characterized in that said frames are U-shaped, of which the ends of their opposite branches forming uprights are articulated to said base and of which their central branch forming a cross-piece lies underneath and carries said sheet.

19. Dwelling according to claim 14, characterized in that said roof includes a sheet which has at least one portion which extends from said roof so as to constitute a third sidewall which is connected to both of said opposite sidewalls.

20. Dwelling according to claim 14, characterized in that roof has a peripheral extension frame which in its opened-out position extends beyond one of said opposite sidewalls, this extension frame being connected to said one of said opposite sidewalls and being able to be folded down against and outside of the latter.

21. Dwelling according to claim 20, characterized in that a linkage connects said peripheral extension frame of the roof to said deformable frame structure so as to be able to be collapsed at the same time.

22. Dwelling according to claim 20, characterized in that said extension of the roof comprises a U-shaped frame, the ends of the opposite branches of which are connected in an articulated manner to the top part of the associated sidewall, said sheet having a portion which is carried by this peripheral extension frame.

23. Dwelling according to claim 22, characterized in that said sheet portion envelops said peripheral extension frame of the roof.

24. Dwelling according to claim 14, characterized in that it comprises means for retaining said deformable frame structure in the opened-out position.

25. Dwelling according to claim 1, characterized in that said sidewalls have frames and said base comprises a peripheral frame to which the frames of said sidewalls are articulated.

26. Dwelling according to claim 1, characterized in that said sidewalls have frames and said frames are tubular.

27. Dwelling according to claim 1, characterized in that said sidewalls have frames which include branches, and said branches have ends equipped with articulation rings traversed by the frame which carries them.

28. Dwelling according to claim 1 characterized in that said sidewalls include sheets, and said dwelling has a bottom sheet connected to the sheets of said sidewalls.

29. Dwelling according to claim 1, characterized in that at least one of said sheets comprises sheaths into which extend respectively at least some of the branches of the frame which carries it.

30. A dwelling which is collapsible from an opened-out position to a collapsed position, said dwelling comprising, a base structure, first and second sidewall structures connected opposite to each other on said base structure, each of said sidewall structures having a top part, an outer face and an inner face, a roof frame structure which is articulated on the top parts of said opposite sidewall structures, an outside sheet having at least a side portion which covers the outer face of said first sidewall structure and a roof portion which covers said roof frame structure, said roof portion of said outside sheet having an upper face and a lower face in said opened-out .position of the dwelling, said dwelling being collapsible to its collapsed position by folding said first sidewall structure relative to said base structure and then folding said second sidewall structure relative to said base structure, said outside sheet being turned over to its collapsed position during the folding of said sidewall structures, said outside sheet in its collapsed position lying between said first and second sidewall structures, said outside sheet in its collapsed position having said upper face facing down toward the outer face of said first sidewall structure and having its lower face facing up toward the inner face of said second sidewall structure.

31. A collapsible dwelling according to claim 30, further including an extension frame structure which is articulated on the top part of said second sidewall structure to extend the roof, said outside sheet having an extension portion which overlies and is supported by said extension frame structure, said extension frame structure having a collapsed position where it is folded on the outer face of said second sidewall structure.

32. A collapsible dwelling according to claim 31, comprising means for simultaneously folding said sidewall structure and said extension frame structure.

33. Collapsible dwelling according to claim 32, wherein said means includes a sleeve mounted for vertical sliding movement on said second sidewall structure, and links which each have one end articulated on said sleeve, said links having other ends which are respectively articulated on said roof frame structure and on said extension frame structure.

34. Collapsible dwelling according to claim 31, wherein said extension frame structure comprises a peripheral U-shaped frame which has branches with ends articulated on the top part of said second sidewall structure.

35. Collapsible dwelling according to claim 30, wherein said base structure comprises a peripheral frame with opposite branches, said sidewall structures each including a U-shaped frame with a top bar connected to opposite branches having ends which are articulated on opposite branches of said peripheral frame, and said roof structure includes two opposite bars having ends which are articulated on the top bars of said sidewall frame structures.

36. Collapsible dwelling according to claim 30, wherein said sheet has lateral edges, and means are provided for connecting said lateral edges to other sheets.

37. Collapsible dwelling according to claim 30, provided with means for maintaining it in its opened-out position.

38. Collapsible dwelling according to claim 37, wherein said means includes at last one jack.

* * * * *